US005226718A

United States Patent [19]

Lin

[11] Patent Number: 5,226,718

[45] Date of Patent: Jul. 13, 1993

[54] MOUNTAINEERING STICK HAVING WARNING AND LIGHTING MEANS AND CAPABLE OF BEING DISMANTLED AND ASSEMBLED RAPIDLY

[76] Inventor: Jy-Tsair Lin, 100, Yeou-Herng St., South Dist., Taichung, Taiwan

[21] Appl. No.: 886,355

[22] Filed: May 21, 1992

[51] Int. Cl.[5] ..... A45B 3/04; B25F 1/00

[52] U.S. Cl. ..... 362/119; 362/120; 362/102; 362/109; 7/159; 7/145; 7/170

[58] Field of Search ..... 362/119, 120, 102, 109; 7/159, 145, 170

[56] References Cited

U.S. PATENT DOCUMENTS

| | | | |
|---|---|---|---|
| 2,173,624 | 9/1939 | Dyer | 362/102 |
| 2,245,349 | 6/1941 | Lombardi | 362/102 |
| 4,114,216 | 9/1978 | Gathy | 7/145 |
| 4,476,597 | 10/1984 | Gobbi | 7/159 |
| 4,625,742 | 12/1986 | Philips | 362/102 |

*Primary Examiner*—Ira S. Lazarus
*Assistant Examiner*—L. Heyman
*Attorney, Agent, or Firm*—Larson and Taylor

[57] ABSTRACT

A mountaineering stick comprises a plurality of segments, each of which can be detached and reassembled by means of eccentric structures. A lighting device of special design is affixed to the stick for lighting and warning purposes. Such stick can be easily carried by the mountain climber and is durable.

1 Claim, 4 Drawing Sheets

MOUNTAINEERING STICK HAVING WARNING AND LIGHTING MEANS AND CAPABLE OF BEING DISMANTLED AND ASSEMBLED RAPIDLY

BACKGROUND OF THE INVENTION

The present invention relates to a mountaineering equipment, and more particularly to a mountaineering stick having warning and lighting means and capable of being dismantled and assembled repidly.

The mountain climbing is an extremely exhausting and taxing outdoor activity. As a result, a variety of mountaineering equipments are made available to help the mountain climbers in such a way that the consumption of their body energy is effectively reduced. The mountaineering stick is one of the most important tools used by the mountain climbers and is generally provided with a handle fitted to a toothed pick intended for use by the climber to dig so as to remove the obstructions of topographic nature. In order to make the mountaineering stick easy to be carried by the mountain climber, the handle of such conventional stick is divided into segments, which are joined together by means of threaded joints and can be thus dismantled and reassembled. However, such conventional mountaineering stick is defective in design in that it takes time to join the segments making up of the handle and that the threaded joints are vulnerable to breaking apart.

SUMMARY OF THE INVENTION

It is therefore the primary objective of the present invention to provide a mountaineering stick, which can be rapidly dismantled and reassembled.

The foregoing objective, features and sturctures of the present invention will be better understood by studying the following detailed description of the preferred embodiment in conjunction with the drawings provided herewith.

DETAILED DESCRIPTION OF THE PREFERRED EMBODIMENT

Figure 1:
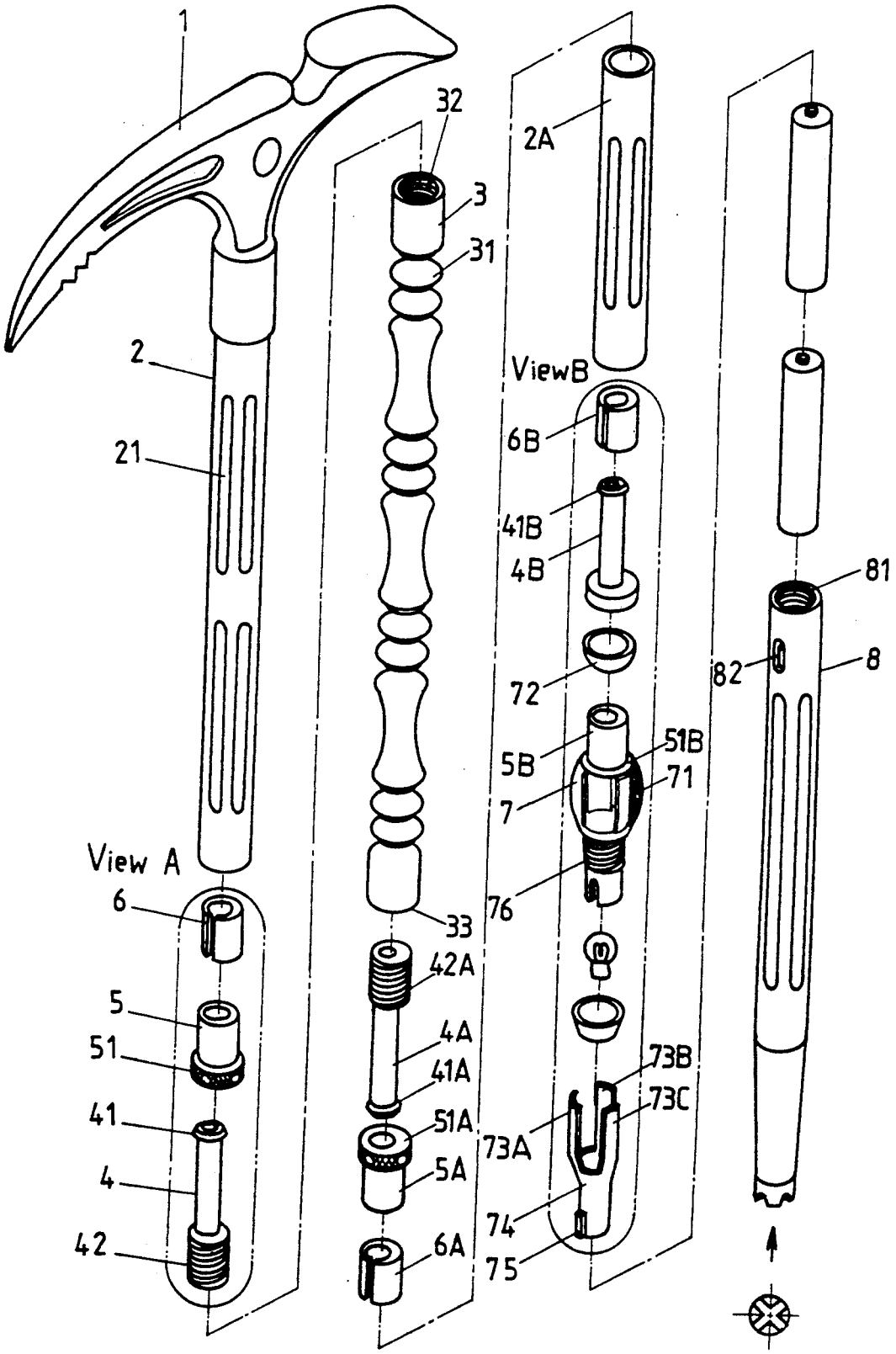
FIG. 1 shows an exploded view of the preferred embodiment of the present invention.

Referring to FIGS. 1-5, the mountaineering stick of the present invention is shown comprising a hoe-like handle 1 having a hollow metal columnar body 2 of appropriate length disposed at the middle of the bottom side thereof. The outer surface of the columnar body 2 is provided with a plurality of strip grooves 21. The columnar body 2 has a columnar rod 3 of hollow construction disposed at the bottom end thereof. The external surface of the hollow columnar rod 3 is composed of cones 31 and upper and lower threaded holes 32 and 33 disposed at both ends thereof and positioned correspondingly to hollow eccentric shafts 4 and 4A comprising respectively protruded retaining edges 41 and 41A at one end thereof and threads 42 and 42A at other end thereof intended to engage the upper and the lower threaded holes 32 and 33 of the columnar rod 3. In addition, there are insulated eccentric shaft sleeves 5 and 5A, shaft sleeve edges 51 and 51A, and indented eccentric shaft sleeves 6 and 6A. Another columnar body 2A of hollow construction is disposed at the bottom end of the component parts described above. The columnar body 2A is provided at terminal end thereof with another hollow eccentric shaft 4B, a protruded retaining edge 41B, an insulated eccentric shaft sleeve 5B, a shaft sleeve edge 51B and an indented eccentric retaining sleeve 6B. The bottom end of eccentric shaft 4B is provided with a transparent and hollow spherical lighting shade 7 having a reflector 71 disposed thereto. The reflector 71 occupies about ⅓ of the total area of lighting shade 7. A reflecting mirror 72 is disposed internally at the top end of lighting shade 7. In addition, disposed at inner side of bottom end of lighting shade 7 is a reflecting light seat 74 having three elastic pieces 73A,73B, and 73C. A switching lug 75 is disposed at the outer edge of the bottom end of reflecting light seat 74 extending outside the lighting shade 7. A thread 76 is disposed at the outer edge of reflecting light seat 74, while a fastening thread 81 is disposed at the upper end of the bottom column 8. A Switching hole 82 is disposed at the switching lug 75. The bottom column 8 comprises at the bottom end thereof a lug 83 with cross-shaped recess and a housing for receiving batteries. A light bulb is disposed inside the reflecting light seat 74 to complete the process of constructing the mountaineering stick of the present invention.

Figure 2:
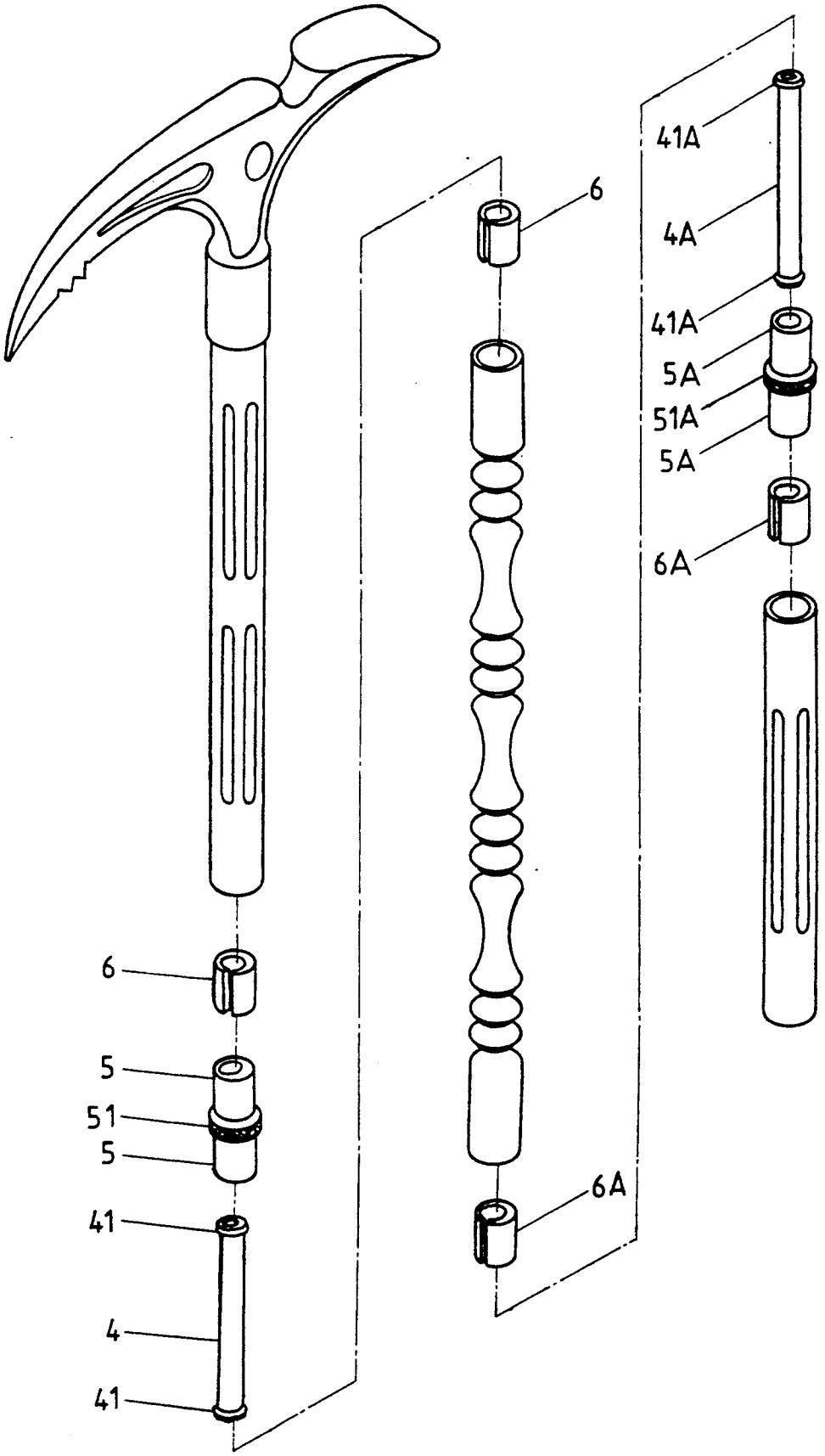
FIG. 2 shows an exploded view of another hollow eccentric shaft provided with both ends devoid of thread according to the present invention.
Figure 3:
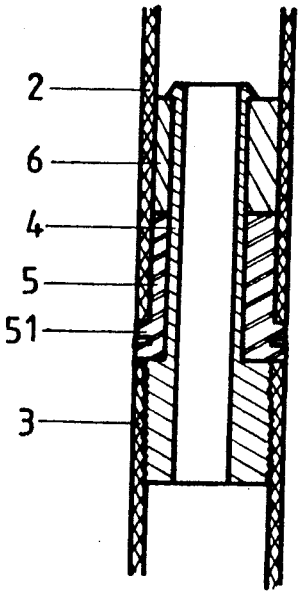
FIG. 3 shows sectional schematic view of eccentric shaft, eccentric shaft sleeve, indented eccentric retaining sleeve, and column according to the present invention.
Figure 5:
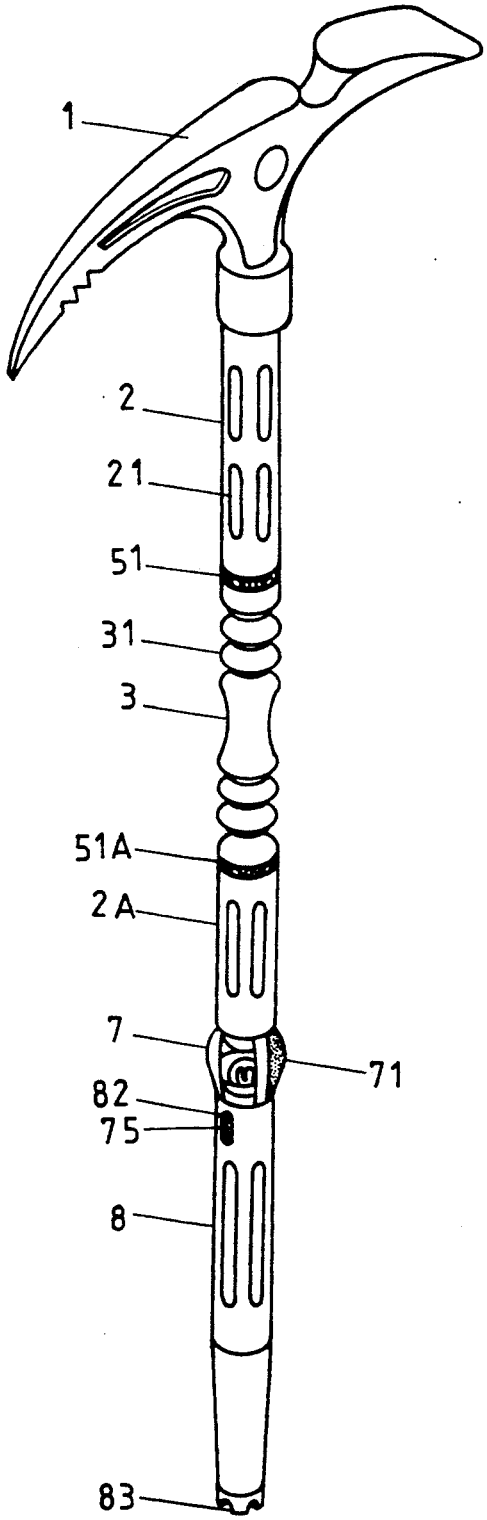
FIG. 5 shows a three-dimensional view of component parts in combination according to the present invention.

Now referring to FIG. 3, the hollow eccentric shafts 4, 4A,4B are respectively fastened to the threaded holes 32,33, and 81 of columnar rods 3 and 8 by means of threads 42, 42A, and 76. The insulated eccentric shaft sleeves 5, 5A, 5B and eccentric retaining sleeves 6, 6A, and 6B are of thickness without having the same center and are respectively fitted to the eccentric shafts 4, 4A, and 4B. Therefore the stick can have different thickness by means of various combinations of eccentric shaft sleeves, indented eccentric retaining sleeves and eccentric shafts, such as 4-5-6, 4A-5A-6A,4B-5B-6B. Such combinations can be easily fitted into the lower end and 2A upper lower end of the hollow columnar body 2. When the shaft sleeve sleeve edges 51,51A, and 51B are fastened at upper and lower ends, the eccentric shaft sleeve, indented eccentric shaft sleeves 5, 5A, 5B and 6, 6A,6B can be made to form a stick of greater diameter, which can be retained in the hollow columnar bodies 2 and 2A and can be detached by rotating. In addition, if required, both ends of eccentric shafts 4 and 4A can be designed as eccentric structures, as shown in FIG. 2. Such design is an extention of application of principles of the present invention.

Figure 4:
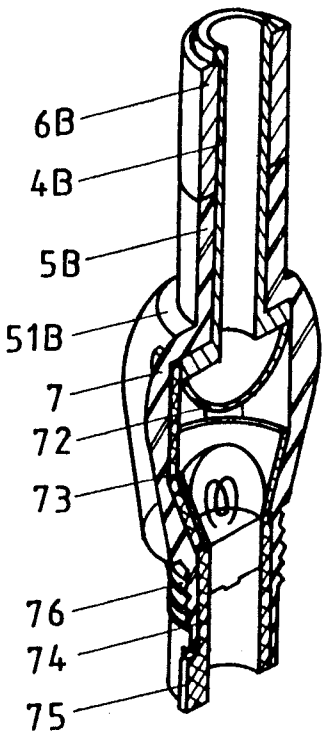
FIG. 4 shows a three-dimensional sectional view of the lighting shade of the present invention.

As shown in FIG. 4, the reflecting light seat 74 comprises a reflecting mirror of round conical cylindrical shape and a plurality of elastic pieces 73A, 73B, 73C, all of which can be pushed into the interior of lighting shade 7 so as to allow the reflecting light seat 74 to comprises a reflecting mirror of round conical cylindrical shape and a plurality of elastic pieces 73 A, 73B,73C, all of which can be pushed into the interior of lighting shade 7 so as to allow the reflecting light seat 74 join the lighting shade 7. The thread 76 at the bottom of the lighting shade 7 engages with the thread 81 located at the upper end of the bottom column 8. As a result, the switching lug 75 is positioned at the switching hole 82. The light can be turned on and off by pressing the lug 75. Futhermore, the lighting shade is provided with convex lenses serving to transmit the light farther. A reflector 71 is disposed at appropriate area of convex lenses of lighting shade 7 so as to allow the light of other sources to reflect in order to make it easy for the person holding the mountaineering stick of the present invention to be located. The mountaineering stick of the present invention can be dismantled and reassembled rapidly by means of a plurality of eccentric means. Such mountaineering stick is easy to use and is very durable. and warning means. The bottom end of the stick is provided with a cross-shaped recess so as to serve as an anchor in the soil in order to prevent the mountain climber from tripping. Furthermore, the columnar bodies of the mountaineering stick of the present invention are provided with strip grooves and bumpy cones, which serve to enhance the contact friction between the stick and the hand and which may be used as tools for massaging the back and the sole of the mountain climber. In other words, the mountaineering stick of the present invention has multiple utilization values.

What is claimed is:

1. A mountaineering stick having warning and light means and capable of being dismantled and assembled rapidly comprising; a metal hollow columnar body fitted to a middle of a bottom side of a hoe-like handle, said columnar body comprising on its outer wall surface a plurality of strip grooves; a hollow columnar rod attached to a lower end of said columnar body, said rod provided externally with conical structures and with upper/and lower threaded holes at both ends thereof; a second columnar body disposed at a bottom end of said columnar rod; and an eccentric shaft of hollow construction engaging a lower end of said second columnar body, said eccentric shaft having a protruded retaining edge at a top end and a lower end provided with one of a threaded end and protruded retaining edges at both ends; said mountaineering stick further comprising an insulated eccentric shaft sleeve, a shaft sleeve edge, and an indented eccentric retaining sleeve fitted to said eccentric shaft, a transparent hollow spherical light shade positioned at a lower end of said eccentric shaft and having a reflector attached thereto, a reflecting mirror disposed internally at a top end of said light shade, a reflecting light seat having three elastic pieces disposed at an inner side of a lower end of said light shade, a light bulb disposed inside said reflecting light seat, a switching lug disposed at an outer edge of the lower end of said reflecting light seat, a switching hole positioned at said switching lug, and a thread located at the outer edge of said reflecting light seat, said lighting shade being coupled with a bottom column, said bottom column comprising a housing for batteries and a bottom end with a cross-shaped recess.

* * * * *